United States Patent [19]

Messenger

[11] 4,194,580

[45] Mar. 25, 1980

[54] DRILLING TECHNIQUE

[75] Inventor: Joseph U. Messenger, Dallas, Tex.

[73] Assignee: Mobil Oil Corporation, New York, N.Y.

[21] Appl. No.: 892,794

[22] Filed: Apr. 3, 1978

[51] Int. Cl.[2] ..... E21B 7/04

[52] U.S. Cl. ..... 175/61; 166/50

[58] Field of Search ..... 175/61, 62, 73, 45, 175/78–81; 166/50, 117.5, 117.6, 254

[56] References Cited

U.S. PATENT DOCUMENTS

| | | | |
|---|---|---|---|
| 2,271,005 | 1/1942 | Grebe | 175/61 |
| 2,280,851 | 4/1942 | Ranney | 175/61 |
| 2,404,341 | 7/1946 | Zublin | 175/61 X |
| 2,565,794 | 8/1951 | Young | 175/61 |
| 2,646,254 | 7/1953 | Johnston | 175/61 |
| 3,401,749 | 9/1968 | Daniel | 166/254 X |
| 3,406,766 | 10/1968 | Henderson | 175/61 |
| 3,598,190 | 8/1971 | Pfau | 175/61 |

OTHER PUBLICATIONS

Gatlin Petroleum Engineering, Drilling and Well Completions (1960), Prentice Hall Inc., Englewood Cliffs, N.J., pp. 160, 161.

*Primary Examiner*—James A. Leppink
*Assistant Examiner*—Richard E. Favreau
*Attorney, Agent, or Firm*—C. A. Huggett; Henry L. Ehrlich; William J. Scherback

[57] ABSTRACT

This specification discloses a technique of providing a wellbore that extends from a surface location to a subsurface location in a mineral bearing formation which subsurface location is spaced a great lateral distance from the surface location. The wellbore is provided to have a first portion that extends essentially vertically from the surface location into the earth's crust and into a formation having good drilling characteristics, a second portion that extends for a great distance within and essentially parallel to the bedding plane of the formation having good drilling characteristics, and a third portion that extends essentially vertically from the farthest extension of the second portion to the subsurface location in the mineral bearing formation.

2 Claims, 1 Drawing Figure

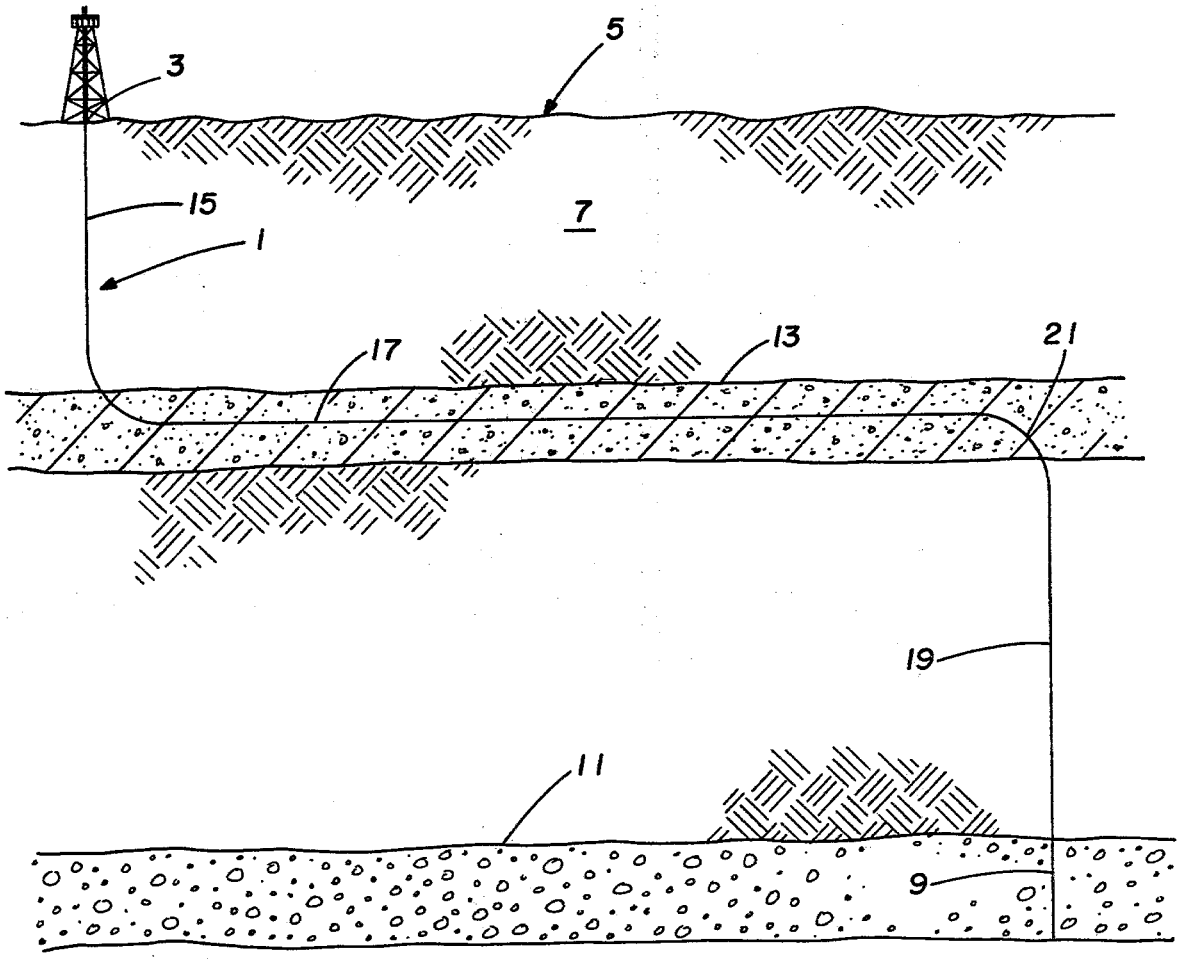
3
5
15
7
1
17
13
21
19
11
9

DRILLING TECHNIQUE

BACKGROUND OF THE INVENTION

This invention is concerned with a technique for providing a wellbore that extends from a surface location into the earth's crust and through formations thereof to a subsurface location in a mineral bearing formation which subsurface location is spaced a great lateral distance from the surface location.

Wellbores and wells have been extended into the earth in directions other than vertical for various reasons and by various techniques. A need for such wells was early recognized and still exists today for tapping mineral reserves located beneath water bodies or located beneath other poorly accessible surface locations. For example, before the turn of the century, the Summerland Field, located underwater near Santa Barbara, Calif., was drilled by whipstocking holes out under the water from land locations.

In U.S. Pat. No. 3,285,350 to J. K. Henderson, there is described a technique for drilling off-vertical holes through earth formations and more particularly a technique and apparatus for controllably drilling holes through and substantially parallel to mineral formations between separated wells.

In U.S. Pat. No. 2,778,603 to McCune et al., there is described a method and apparatus for lining wellbores, such as bores extending laterally or generally horizontally from a main bore into a surrounding formation. In U.S. Pat. No. 3,933,447 to Pasini et al., there is described a method for the gasification of coal in situ. In one aspect there described, a borehole is drilled from the earth's surface preferably on a slant so as to intersect the coal bed while traveling in a horizontal direction. Using this technique, it was found that major advantages are achieved over the use of vertical wells or blind boreholes. In U.S. Pat. Nos. 3,986,557 and 4,007,788 both to Striegler et al., there are described methods of producing bitumen from subterranean tar sand formations which methods employ a continuous wellbore having a second section thereof contained within the formation and a first and a third section extending said second section to the earth's surface.

SUMMARY OF THE INVENTION

This invention is directed to a method of providing a wellbore that extends into the earth's crust intermediate a surface location and a subsurface location within a mineral bearing formation which subsurface location is spaced a great lateral distance from said surface location. A first portion of the wellbore is formed to extend vertically from the surface location into the earth's crust and into a formation thereof having good drilling characteristics. A second portion thereof is formed to extend from the first portion into the formation having good drilling characteristics and extend essentially parallel to the bedding plane thereof and a great lateral distance to a location essentially vertically above the subsurface location. A third portion of the wellbore is then formed to extend essentially vertically from the location above the subsurface location to the subsurface location in the mineral bearing formation.

BRIEF DESCRIPTION OF THE DRAWING

The drawing is a schematic view illustrating the track of a wellbore provided in accordance with the method of this invention.

DESCRIPTION OF THE PREFERRED EMBODIMENTS

This invention is directed to a technique of providing a wellbore that extends from a surface location to a subsurface location spaced a great lateral distance therefrom in a mineral bearing formation. The wellbore may then be completed to provide a well for producing the minerals from the formation.

I have discovered a technique of providing a wellbore that extends from a surface location to a subsurface location spaced a great lateral distance therefrom by which technique the wellbore is provided along essentially a track of least drilling difficulty rather than along essentially a track of most direct travel path between the surface location and the subsurface location.

Within the earth's crust normally there are located a number of different earth formations which have individual characteristics. Some of these formations may be very hard and difficult to drill; others may be soft and unstable and present drilling problems because of caving and sloughing; and still others may be easier to drill than the earth's crust in general and be stable such that an essentially gauge wellbore may be drilled and maintained therein without the formation sluffing or caving into the wellbore. Such a formation that is easier to drill than the earth's crust in general is referred to as one having good drilling characteristics.

In accordance with this invention, there is described a method of providing a wellbore that extends from a surface location of the earth to a subsurface location in a mineral bearing formation, such as a hydrocarbon bearing formation and hereafter referred to as a hydrocarbon bearing formation, which subsurface location is spaced laterally therefrom a great distance. The wellbore is provided to have a first portion that extends essentially vertically from the surface location into the earth's crust and into a formation having good drilling characteristics. The wellbore is then deviated toward a horizontal direction and there is provided a second portion thereof that extends for a great distance within and essentially parallel to the bedding plane of the formation having good drilling characteristics and thereafter the well is deviated toward a vertical downward direction and there is provided a third portion thereof that extends essentially vertically to the subsurface location in the hydrocarbon bearing formation. The wellbore may be cased and completed to provide a well for producing minerals such as hydrocarbons from the mineral bearing formation.

From a practical standpoint, this invention is applicable only to those situations where the subsurface location is spaced laterally at least about 10,000 feet and vertically at least about 5,000 feet from the surface location and where there is located within the earth's crust a formation that has good drilling characteristics. It is in such situations as this that a wellbore may be provided more efficiently and economically in accordance with my technique than by present-known techniques.

A formation having good drilling characteristics may be located within the earth's crust in the normal course of drilling a wellbore. Such a formation may be, for example, a nonsluffing shale or a consolidated sandstone formation.

State of the art drilling techniques may be used for providing the wellbore of this invention. In the beforementioned Henderson patent, there is described a method and apparatus for controllably drilling holes through and substantially parallel to formations between separated wells. In the Striegler et al. patents, there are shown continuous wellbores that have one portion extending in a subsurface formation and connected at both ends to other portions which extend to the surface of the earth. Using similar drilling techniques, the wellbore of this invention may be provided.

Turning now to the drawing for a more detailed description of this invention, there is shown schematically a wellbore 1 that extends from a surface location 3 at the earth's surface 5 and through the earth's crust 7 to a subsurface location 9 within a hydrocarbon bearing formation 11 located a great lateral distance such as at least 10,000 feet from the surface location. Within the earth's crust 7 there is shown a formation 13 that has good drilling characteristics. In the carrying out of this invention the wellbore 1 is provided to have a first portion 15 that extends essentially vertically from the surface location 3 to the formation 13 having good drilling characteristics. This first portion 15 could be provided along a slant track rather than a vertical track but it is normally more efficient to drill this first portion 15 essentially along a vertical track. The formation 13 having good drilling characteristics may be located during the drilling of the first portion 15 of the wellbore 1 by noting the drilling characteristics of the formations of the earth's crust 7 penetrated. However, if other wells have been drilled in the same locality, the drilling characteristics of the formations in the earth's crust 7 can be determined by reviewing the well logs obtained from such logs. From such logs the general depth and drilling characteristics of the formation 13 can be determined before initiating the drilling of the wellbore 1. The track of the wellbore 1 is deviated to provide a second portion 17 to extend within and essentially parallel to the bedding plane of the formation to a location 21 normally essentially vertically above the subsurface location 9. In the case as illustrated in the drawing, where the bedding plane of the formation 13 is essentially horizontal, the second portion 17 of the wellbore 1 will be essentially horizontal, also. As before mentioned, this second portion 17 will normally have a length of at least about 10,000 feet or greater and the subsurface location 9 will normally be at a depth of at least 5000 feet below the earth's surface. The wellbore 1 is deviated at the farthest extension of the second portion 17 and a third portion 19 is provided to extend essentially vertically therefrom to the subsurface location 9 of the hydrocarbon bearing formation 11. The wellbore may then be completed and the hydrocarbons from the hydrocarbon bearing formation 11 produced therethrough to the surface of the earth.

In the drawing, the deviated portions of the wellbore 1 are shown schematically as being rather sharp but in actual practice may be much more gentle. Also, the vertical portions 15 and 19 of the wellbore 1 may be provided with some slant though broadly are considered to be essentially vertical. The second portion 17 of the wellbore 1 is shown essentially horizontal paralleling the horizontal bedding plane of the formation 13 and the formation 13 is illustrated as being rather thin. In those cases where the formation 13 is thick, the second portion 17 of the wellbore 1 may slant somewhat across the bedding plane thereof so long as it remains within the formation 13.

The formation 13 in the drawing is illustrated as being located intermediate the earth's surface 5 and the hydrocarbon bearing formation 11. In accordance with another aspect of this invention, the hydrocarbon bearing formation 11 may be a formation having good drilling characteristics in which case the wellbore 1 may be provided to extend vertically into the formation 11 and then laterally for at least 10,000 feet to the subsurface location 9. In accordance with still another aspect of this invention, the formation 13 having good drilling characteristics may be located below the hydrocarbon formation 11 in which case the first portion 15 of the wellbore 1 would extend vertically through the hydrocarbon bearing formation 11 and into the formation 13 therebelow and laterally therein and the third portion 19 would extend therefrom upwardly to the subsurface location 9.

What is claimed is:

1. A method of providing a wellbore that extends into the earth's crust intermediate a surface location and a subsurface location spaced laterally therefrom in a mineral bearing formation, comprising:

(a) forming a first portion of said wellbore to extend essentially vertically from said surface location into said earth's crust and into a formation thereof having good drilling characteristics located intermediate said surface location and said mineral bearing formation;

(b) forming a second portion of said wellbore to extend from the lower end of said first portion into said formation having good drilling characteristics which second portion extends therein essentially parallel to the bedding plane thereof for a great lateral distance; and (c) forming a third portion of said wellbore to extend essentially vertically from the farthest extension of said second portion to said subsurface location in said mineral bearing formation.

2. A method of providing a wellbore that extends into the earth's crust intermediate a surface location and a subsurface location spaced laterally therefrom in a mineral bearing formation, comprising:

(a) locating within said earth's crust from prior drilled wells a formation having good drilling characteristics;

(b) forming a first portion of said wellbore to extend essentially vertically from said surface location into said earth's crust and into said formation having good drilling characteristics;

(c) forming a second portion of said wellbore to extend from the lower end of said first portion into said formation having good drilling characteristics and extend therein essentially parallel to the bedding plane thereof for a distance at least about 10,000 feet to a location essentially vertically above said subsurface location; and (d) forming a third portion of said wellbore to extend essentially vertically from said location essentially vertically above said subsurface location to said subsurface location in said mineral bearing formation.

* * * * *